US008023868B2

(12) United States Patent
Yamada et al.

(10) Patent No.: US 8,023,868 B2
(45) Date of Patent: Sep. 20, 2011

(54) DEVELOPMENT ROLLER, DEVELOPMENT DEVICE, AND IMAGE FORMING APPARATUS

(75) Inventors: Yoichi Yamada, Shiojiri (JP); Masahiro Maeda, Matsumoto (JP); Junichi Suzuki, Chino (JP); Takatomo Fukumoto, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 286 days.

(21) Appl. No.: 12/388,880

(22) Filed: Feb. 19, 2009

(65) Prior Publication Data

US 2009/0208256 A1 Aug. 20, 2009

(30) Foreign Application Priority Data

Feb. 20, 2008 (JP) ..... 2008-038702
Feb. 20, 2008 (JP) ..... 2008-038703

(51) Int. Cl.
*G03G 15/08* (2006.01)

(52) U.S. Cl. ..... 399/286

(58) Field of Classification Search ..... 399/265, 399/279, 286

See application file for complete search history.

(56) References Cited

U.S. PATENT DOCUMENTS

| | | | | |
|---|---|---|---|---|
| 4,368,971 | A | 1/1983 | Watanabe et al. | |
| 4,564,285 | A | 1/1986 | Yasuda et al. | |
| 4,737,216 | A | 4/1988 | Lounsbury, Jr. et al. | |
| 4,866,480 | A | 9/1989 | Hosoya et al. | |
| 5,062,385 | A | 11/1991 | Nishio et al. | |
| 5,387,966 | A | 2/1995 | Karashima | |
| 6,104,903 | A | 8/2000 | Hara et al. | |
| 6,149,564 | A | 11/2000 | Nozawa et al. | |
| 6,201,942 | B1 | 3/2001 | Honda et al. | |
| 6,205,313 | B1 | 3/2001 | Bean | |
| 6,512,910 | B2 * | 1/2003 | Aoki et al. | 399/286 |
| 6,681,092 | B2 | 1/2004 | Terai | |
| 6,725,007 | B2 | 4/2004 | Igarashi | |
| 6,873,816 | B2 | 3/2005 | Akashi et al. | |
| 7,209,691 | B2 | 4/2007 | Takahashi et al. | |
| 7,565,099 | B2 | 7/2009 | Yamada et al. | |
| 7,702,264 | B2 * | 4/2010 | Hirota et al. | 399/265 |
| 7,907,879 | B2 | 3/2011 | Yamada et al. | |
| 2006/0062599 | A1 | 3/2006 | Shimmura et al. | |
| 2007/0104517 | A1 | 5/2007 | Shimmura et al. | |

(Continued)

FOREIGN PATENT DOCUMENTS

JP 64005738 A 1/1989

(Continued)

OTHER PUBLICATIONS

European search report for corresponding European application 09002261.7 lists the references above.

(Continued)

*Primary Examiner* — Susan Lee
(74) *Attorney, Agent, or Firm* — DLA Piper LLP (US)

(57) ABSTRACT

A development roller includes a base unit having a base recess and a base projection that are formed in a predetermined area of a circumference surface of the base unit by pressing a regular pattern in pressure machining, and a surface layer formed on the circumference surface of the base unit and having a recess and a projection formed respectively in accordance with the base recess and the base projection of the base unit. A thickness of the surface layer is larger than a maximum height of a base swollen portion close to the side edge of the base projection from a regular surface of the base projection.

12 Claims, 11 Drawing Sheets

U.S. PATENT DOCUMENTS

| | | | | |
|---|---|---|---|---|
| 2007/0110481 | A1 | 5/2007 | Yamada et al. | |
| 2007/0110484 | A1 | 5/2007 | Yamada et al. | |
| 2007/0177908 | A1 * | 8/2007 | Aruga et al. | 399/286 |
| 2007/0206240 | A1 | 9/2007 | Koike et al. | |
| 2007/0212088 | A1 | 9/2007 | Koike et al. | |
| 2008/0298853 | A1 * | 12/2008 | Yamada et al. | 399/279 |

FOREIGN PATENT DOCUMENTS

| | | | |
|---|---|---|---|
| JP | 01170969 | A | 7/1989 |
| JP | 01253776 | A | 10/1989 |
| JP | 02121740 | A | 5/1990 |
| JP | 08227219 | A | 9/1996 |
| JP | 11119554 | A | 4/1999 |
| JP | 2000284586 | A | 10/2000 |
| JP | 2001154477 | A | 6/2001 |
| JP | 2004037951 | A | 2/2004 |
| JP | 2006091833 | A | 4/2006 |
| JP | 2006201505 | A | 8/2006 |
| JP | 2006259384 | A | 9/2006 |
| JP | 2006267805 | A | 10/2006 |
| JP | 2007-121948 | | 5/2007 |
| JP | 2007183312 | A | 7/2007 |
| JP | 2007199196 | A | 8/2007 |
| JP | 2007218993 | A | 8/2007 |
| JP | 2007233196 | A | 9/2007 |
| JP | 2007264519 | A | 10/2007 |
| JP | 2007279251 | A | 10/2007 |
| JP | 2008009059 | A | 1/2008 |
| JP | 2008020862 | A | 1/2008 |
| JP | 2008031519 | A | 2/2008 |
| JP | 2008122481 | A | 5/2008 |
| JP | 2008122715 | A | 5/2008 |

OTHER PUBLICATIONS

Extended European search report dated Feb. 8, 2010 or corresponding European application 09002262.5.

European search report dated Jun. 5, 2009 for corresponding European application 09002337.5.

* cited by examiner

AGING OF DEVELOPMENT ROLLER

| | |
|---|---|
| ROUGHNESS DEPTH | 6 μm |
| ROUGHNESS PITCH | 100 μm |
| PROJECTION WIDTH | 60 μm |
| RECESS WIDTH | 40 μm |

TONER PARTICLE DIAMETER > ROUGHNESS DEPTH OF DEVELOPMENT ROLLER

AGING OF DEVELOPMENT ROLLER

TONER PARTICLE DIAMETER < ROUGHNESS DEPTH OF DEVELOPMENT ROLLER

AGING OF DEVELOPMENT ROLLER

AGING OF DEVELOPMENT ROLLER

| | |
|---|---|
| ROUGHNESS DEPTH | 6 μm |
| ROUGHNESS PITCH | 100 μm |
| PROJECTION WIDTH | 60 μm |
| RECESS WIDTH | 40 μm |

TONER PARTICLE DIAMETER < ROUGHNESS DEPTH OF DEVELOPMENT ROLLER

AGING OF DEVELOPMENT ROLLER

DEVELOPMENT ROLLER, DEVELOPMENT DEVICE, AND IMAGE FORMING APPARATUS

BACKGROUND

1. Technical Field

The present invention relates to a development roller having a roughness on the circumference thereof for transporting toner to a latent image bearing unit, a development device containing the development roller, and an image forming apparatus containing the development device.

2. Related Art

Development devices developing a toner image from a latent image with one-component non-magnetic toner triboelectrically charge the toner on a development roller. The development roller has a surface roughness on the circumference thereof, the roughness having a substantially flat top surface. The development roller includes a base unit having a roughness portion of grooves on the circumference thereof formed through component rolling, and a surface layer having a uniform thickness formed through plating on the surface of the base unit (as disclosed in Japanese Unexamined Patent Application Publication No. JP-A-2007-121948).

As illustrated in FIG. 11A, a development roller a includes a base unit b and a surface layer c plated on the base unit a as a coverage.

A toner feed roller and a toner regulator unit typically remain in contact with the development roller. Silica having a high hardness is used as an external additive plating toner mother particles. As image forming operations are repeated by many times, the outer circumference of the development roller is worn. The surface layer on the development roller is thus designed to control wear of the circumference of the development roller.

When a roughness pattern is pressed against the base unit of a development roller a to form a roughness portion, the material of the base unit corresponding to the recess is swollen around the recess. Referring to FIG. 8A, a small portion e is swollen in a radially external direction of the development roller a (in an upward direction in FIG. 8A) from a main surface d serving as a regular surface of a base projection c at the side edges of the base projection c of a main unit b of the development roller a. If the roughness depth is large, the material amount of the recess is large, and the swollen portion e is pronounced. A small base recess f can be caused on the base surface d of the base projection c through centerless machining performed prior to component rolling.

When the surface layer g is formed on the base unit b, a plating process is performed with no consideration given to the base swollen portion e and the base recess f in the related art. A swollen portion i of the surface layer g is caused at the base swollen portion e having a height h from the base surface d larger than a thickness t of the surface layer g ($t<h$).

Although the wear of the surface layer g of the development roller a is controlled as previously described, the degree of wear of the surface layer increases in a long service life of the development roller a. As the surface layer g is worn, the swollen portion i of the surface layer g is rapidly worn as illustrated in FIG. 8B, and the base swollen portion e is exposed at an early stage of service. Even if the durability of the development roller a is increased with the surface layer g, the level of durability of the development roller a is not sufficient. There is still room for improvement in the durability of the development roller a.

Similarly, a base portion k may be swollen in a direction toward the base recess j at the side edge of the base projection c of the base unit b of the development roller a as illustrated in FIG. 8C. A swollen portion n of the surface layer g is caused at the base swollen portion k having an expansion h' from a base side surface m as the regular surface larger than the thickness t of the surface layer g ($t<h'$). The durability of the development roller a is not sufficient, and there is room for improvement.

An amount of toner e transported by the development roller a is regulated by a toner regulator blade f. In one toner regulating method, a predetermined area $f_2$ of the toner regulator blade f, including a front edge portion $f_1$ illustrated in FIG. 11A or a front edge portion $f_2$ illustrated in FIG. 11B, is slid on a flat portion h of a projection g so that the flat portion h has partially no toner e with most of the toner e held in a recess i.

Referring to FIG. 11C, a surface k of the base projection j of the base unit b has a large number of small dents m (only one dent m shown for convenience of explanation) through centerless machining performed prior to the machining of the roughness portion of the base unit b. For this reason, the surface of the base projection j has some degree of surface roughness. A surface layer c at the projection g covering the base projection j also has a large number of small dents n (only one dent n shown for convenience of explanation). The surface layer c has some degree of surface roughness.

In addition to the toner regulator blade f, a toner feed roller (not shown) is forced to be in contact with the development roller a. One of silica and titania, having a high hardness, is used as an external additive covering toner mother particles of the toner e. As the image forming operations are repeated by many times, the surface of the surface layer c at the flat portion h is worn because the toner feed roller and the toner regulator blade f press silica and titania against the development roller a. As illustrated in FIG. 11D, the surface of the surface layer c is smoothed (to a mirror state free from small roughness). A contact area of the toner regulator blade f to the projection g thus increases. As a result, the contact level between the development roller a and the toner regulator blade f is thus raised. The contact level tends to be even larger if part of the flat portion h of the projection g is not covered with the toner e, or if the toner regulator blade f is made of rubber.

If the contact level between the development roller a and the toner regulator blade f is high, the toner regulator blade f suffers from uneven sliding. The toner regulator blade f may be even broken at the front end thereof. A rasping sound may be caused when the toner regulating blade f is pressed against the development roller a. In view of a long service life, there is room for improvement in the durability of the development roller a and the contact level.

SUMMARY

An advantage of some aspects of the invention is that a development roller having a roughness portion formed through component rolling provides a long service life thereof for image development with an increased durability thereof. A development device and an image forming apparatus, each containing the development roller, also provide can perform development operation for a long period of time.

Another advantage of an aspect of the invention is that a development roller maintains durability by controlling contact level with an engagement member even when the surface layer is worn after a long period of usage in image forming, and provides a long service life thereof in image development. A development device and an image forming apparatus, each containing the development roller, also can perform development operation for a long period of time.

In accordance with one aspect of the invention, a base roughness is formed on a base unit in pressure machining of the development roller. In the pressure machining, a small swollen portion is formed at a side edge of a base projection, swollen from a regular surface of the base projection. A surface layer is formed on the circumference of the base unit. A thickness of the surface layer is set to be larger than a maximum height of the base swollen portion from the regular surface of the base projection.

The swollen portion of the surface layer corresponding to the swollen portion of the base unit is first worn in a long service of image development. Even if the swollen portion of the surface layer is worn out, the base unit is prevented from being exposed because a thickness of the surface layer is set as previously discussed. When the swollen portion of the surface layer is worn out, a projection of the surface layer becomes flat corresponding to the regular surface of the base projection of the base unit. The area of the flat surface of the surface layer at the projection is increased. An area under the weight of a toner regulator unit and a toner feed unit is expanded, and the pressure is thus distributed. The wear rate of the flat surface of the surface layer at the projection is thus controlled. In this way, the durability of the development roller is substantially increased, and the toner charging property of the development roller is maintained at an excellent level. The base unit is prevented from being exposed for a long period of time. Even if a corrosive iron-based material is used for the base unit, the base unit is prevented from being corroded for a long period of time.

The development roller of one embodiment of the invention develops a toner image on a latent image bearing unit in response to an electrostatic latent image. If an average diameter of toner particles smaller than the depth of the recess of the development roller is used, the surface of the surface layer at the projection is worn generally flatly. The wear of the surface layer is controlled for a long period of time.

The toner particles are coated with silica having a relatively high hardness as an external additive with the silica coverage ratio to the toner mother particles being 100% or more. Silica is abundant in the surface of the toner mother particles and separated silica is also abundant in the toner. This causes a relatively high wear rate in the surface layer of the projection. Such toner is typically used when toner fluidity is needed in one-component non-magnetic non-contact development. Even if the development roller is used in the development device that uses the toner having a silica coverage rate of 100% or more, the durability of the development roller is still effectively increased.

The image forming apparatus containing the development device of one embodiment of the invention thus provides excellent images for a long period of time.

The surface roughness of the surface layer at the flat portion of the projection is set to be larger than the thickness of the surface layer. The flat portion of the projection of the development roller is thus maintained to a constant surface roughness until the flat portion of the base unit is exposed at the end of the service life of the development roller. Since the surface layer is manufactured through electroless plating, a small recess is more accurately formed in accordance with a base recess of the base unit. An increase in the contact level between the toner regulator blade and the flat portion of the projection is thus controlled for a long period of time.

Uneven sliding of the toner regulator blade on the development roller and a sound of the toner regulator blade are effectively controlled. The breaking of the toner regulator blade may also be avoided. The durability of the development roller and the toner regulator blade are increased. The charging property of the development roller is maintained at an excellent level for a long period of time.

Since an increase in the contact level between the toner regulator blade and the flat portion of the projection is controlled, an increase in the drive torque of the development roller is also restricted for a long period of time.

The development device including the development roller can thus develop toner images on the latent image bearing unit in accordance with latent images for a long period of time.

The front edge portion of the toner regulator blade is kept in contact with the flat portion of the projection so that the flat portion of the projection is partially covered with the toner. In such a toner regulating method, an increase in the contact level between the toner regulator blade and the flat portion of the projection is effectively controlled for a long period of time.

With the roughness portion constructed of regular grooves, the uneven sliding of the toner regulator blade is effectively controlled.

The image forming apparatus containing the development device can provide excellent images for a long period of time.

BRIEF DESCRIPTION OF THE DRAWINGS

The invention will be described with reference to the accompanying drawings, wherein like numbers reference like elements.

FIGS. 4A-4C illustrate a development roller in accordance with a first embodiment of the invention, wherein FIG. 4A is a partial sectional view diagrammatically illustrating one projection of the development roller, FIG. 4B is a partial sectional view diagrammatically illustrating a wear process on the development roller, and FIG. 4C is a partial sectional view diagrammatically illustrating a further wear process on the development roller.

FIGS. 5A-5C illustrate the development roller in accordance with the first embodiment of the invention, wherein FIG. 5A illustrates a size of a roughness of the development roller, FIG. 5B illustrates a wear process of the development roller when a toner particle diameter is larger than a depth of the roughness of the development roller, and FIG. 5C illustrates a wear process of the development roller when the toner particle diameter is smaller than the depth of the roughness of the development roller.

FIGS. 6A-6D illustrate the development roller of the first embodiment of the invention wherein FIG. 6A illustrates the behavior of toner particles when the toner particle diameter is larger than the depth of the roughness of the development roller, FIG. 6B illustrates the wear state of the development roller of FIG. 6A, FIG. 6C illustrates the behavior of toner particles when the toner particle diameter is smaller than the depth of the roughness of the development roller, FIG. 6D illustrates the wear state of the development roller of FIG. 6C.

FIGS. 9A-9C illustrate a development roller in accordance with a second embodiment of the invention, wherein FIG. 9A is a partial sectional view diagrammatically illustrating one projection of the development roller, FIG. 9B is a partial sectional view diagrammatically illustrating a wear process of the development roller, and FIG. 9C is a partial sectional view diagrammatically illustrating a further wear process of the development roller.

FIGS. 10A and 10B illustrate the development roller in accordance with the second embodiment of the invention wherein FIG. 10A illustrates a size of a roughness of the development roller, and FIG. 10B illustrates a wear process of the development roller when a toner particle diameter is smaller than a depth of the roughness of the development roller.

DESCRIPTION OF EXEMPLARY EMBODIMENTS

The embodiments of the invention are described below with reference to the drawings.

Figure 1:
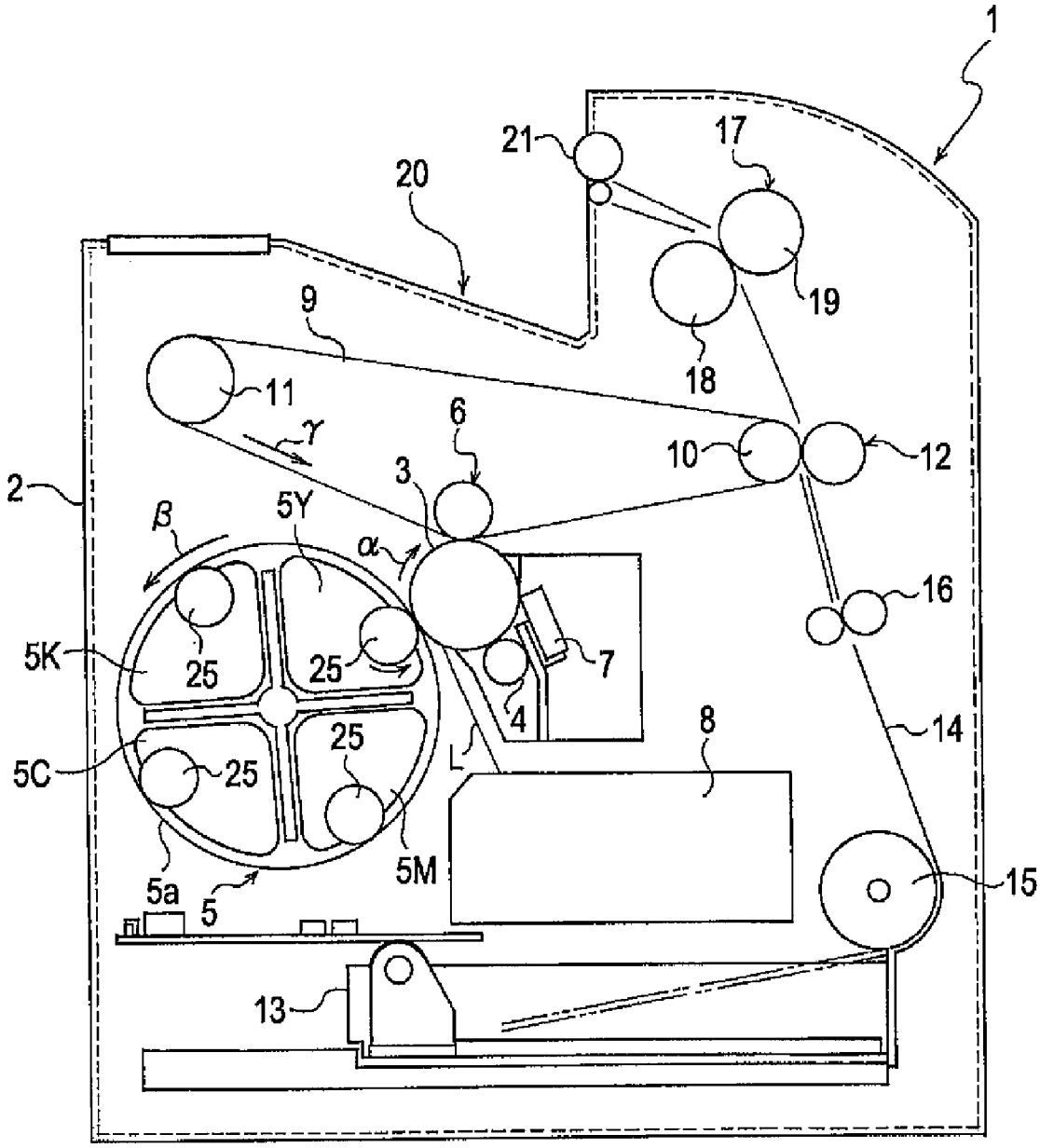
FIG. 1 illustrates an image forming apparatus in accordance with one embodiment of the invention.

FIG. 1 diagrammatically illustrates an image forming apparatus 1 in accordance with one embodiment of the invention.

With reference to FIG. 1, a photoconductor unit 3 as an image bearing unit is supported in an apparatus body 2 in a manner such that the photoconductor unit 3 is clockwise rotated in a direction of rotation a. A charging device 4 is arranged in the vicinity of the circumference of the photoconductor unit 3. Also arranged in the direction of rotation a of from the charging device 4 to the photoconductor unit 3 around the photoconductor unit 3 are a rotary development unit 5 as a development device, a primary transfer device 6, and a cleaning device 7. The rotary development unit 5 includes a development device 5Y for yellow color, a development device 5M for magenta color, a rotary development unit 5C for cyan color, and a development device 5K for black. These development devices 5Y, 5M, 5C and 5K are detachably supported in a rotary 5*a* that is rotatable about a center axis in a direction of rotation β (counterclockwise rotation in FIG. 1). An exposure device 8 is arranged below the charging device 4 and the cleaning device 7.

The image forming apparatus 1 further includes an intermediate transfer belt 9 having an endless structure as an intermediate transfer medium. The intermediate transfer belt 9 is entrained about a belt driving roller 10 and a driven roller 11. A driving force of a motor (not shown) is conveyed to the belt driving roller 10. The belt driving roller 10 causes the intermediate transfer belt 9 to rotate in a rotational direction γ(counterclockwise rotation in FIG. 1) while the intermediate transfer belt 9 is pressed by the primary transfer device 6 against the photoconductor unit 3.

A secondary transfer device 12 is arranged next to the belt driving roller 10 of the intermediate transfer belt 9. A transfer material cassette 13 is arranged below the exposure device 8. The transfer material cassette 13 holds a sheet-like transfer material such as a transfer paper sheet (corresponding to a transfer medium in accordance with one embodiment of the invention). A pickup roller 15 and a gate roller pair 16 are arranged close to the secondary transfer device 12 in a transfer material transport path 14 extending from the transfer material cassette 13 to the secondary transfer device 12.

A fixing device 17 is arranged above the secondary transfer device 12. The fixing device 17 includes a heater roller 18 and a pressure roller 19 pressed against the heater roller 18. A transfer material discharge tray 20 is arranged on the top portion of the apparatus body 2. A pair of transfer material discharge rollers 21 are arranged between the fixing device 17 and the transfer material discharge tray 20.

In the image forming apparatus 1 thus constructed, a yellow electrostatic latent image, for example, is formed on the photoconductor unit 3 uniformly charged by the charging device 4 in response to laser light L from the exposure device 8. The yellow electrostatic latent image is developed on the photoconductor unit 3 by yellow toner of the yellow development device 5Y at a development position (not shown) determined when the rotary 5*a* rotates. A yellow toner image is thus developed on the photoconductor unit 3. The yellow toner image is then transferred to the intermediate transfer belt 9 by the primary transfer device 6. Toner remaining on the photoconductor unit 3 subsequent to the transfer operation is scraped off by a cleaning blade or the like of the cleaning device 7 and then recycled.

Similarly, a magenta image is formed by the exposure device 8 on the photoconductor unit 3 that is uniformly charged by the charging device 4. The magenta electrostatic latent image is developed by magenta toner of the magenta development device 5M at the development position. The magenta image on the photoconductor unit 3 is transferred to the intermediate transfer belt 9 by the primary transfer device 6 in a manner such that the magenta image is superimposed on the yellow image. Toner remaining on the photoconductor unit 3 subsequent the transfer operation is recycled by the cleaning device 7. A similar operation is repeated for cyan and black toners. The toner images are successively formed on the photoconductor unit 3, and then superimposed on the preceding toner images on the intermediate transfer belt 9. A full-color toner image is then formed on the intermediate transfer belt 9. Similarly, toner remaining on the photoconductor unit 3 subsequent to each transfer operation is recycled by the cleaning device 7.

The full-color toner image transferred onto the intermediate transfer belt 9 is then transferred by the secondary transfer device 12 to the transfer material transported from the transfer material cassette 13 via the transfer material transport path 14. The transfer material is then transported to the secondary transfer device 12 at a timing with the full-color toner image of the intermediate transfer belt 9 by the gate roller 16.

The toner image pre-fixed to the transfer material is heated and pressure-fixed by the heater roller 18 and the pressure roller 19 in the fixing device 17. The transfer material having the image thereon is transported via the transfer material transport path 14, discharged to the transfer material discharge tray 20 via the transfer material discharge roller pair 21 and then held there.

A characteristic structure of the image forming apparatus 1 is described below.

The development devices 5Y, 5M, 5C, and 5K in the image forming apparatus 1 are identical in structure. In the discussion that follows, the rotary development unit 5 is representatively discussed without individually referring to the development devices 5Y, 5M, 5C, and 5K. In this case, reference number 5' is used to discriminate the development device from the rotary development unit 5.

Figure 2:
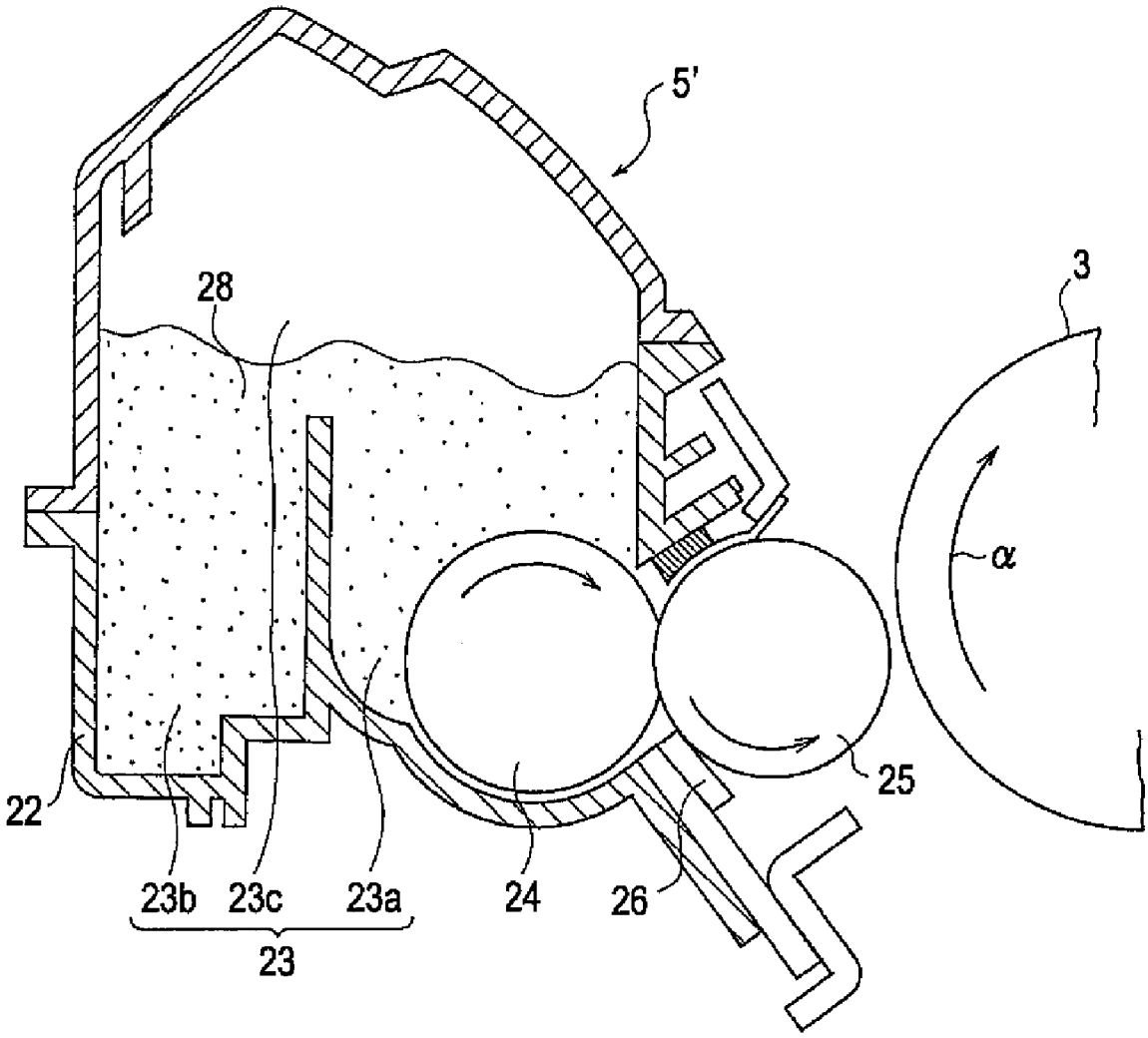
FIG. 2 is a sectional view diagrammatically illustrating a development device illustrated in FIG. 1.

FIG. 2 is a sectional view of the development device 5' taken in a direction perpendicular to the longitudinal direction of the development device 51 in accordance with one embodiment of the invention.

The development device 5' has a form of an elongated container. With reference to FIG. 2, the development device 5' has the same structure as the development device disclosed in Japanese Unexamined Patent Application Publication No. JP-A-2007-121948. More specifically, the development device 5' includes in an elongated housing 22 a toner container 23, a toner feed roller 24, a development roller 25, and a toner regulator member 26. The toner container 23, the toner feed roller 24, the development roller 25, and the toner regulator member 26 extend in the longitudinal direction of the development device 5' (i.e., in a direction perpendicular to the plane of the page of FIG. 2).

The toner container 23 is partitioned into two toner compartments 23*a* and 23*b* by a partitioning wall 27. The toner container 23 includes a common section 23*c* through which the first and second toner compartments 23*a* and 23*b* are open to each other in FIG. 2. The partitioning wall 27 limits the movement of toner 28 between the first and second toner compartments 23*a* and 23*b*. When the development device 5' is turned upside down from the position illustrated in FIG. 2 with the rotary 5*a* of the rotary development unit 5 rotated, the toner 28 stored in each of the first and second toner compartments 23*a* and 23*b* moves to the common section 23*c*. The rotary 5*a* further rotates, causing the development device 5' to be positioned to the state illustrated in FIG. 2. The toner 28 then moves back to each of the first and second toner compartments 23*a* and 23*b*. In this way, part of the toner 28 previously held in the first toner compartment 23*a* is moved to the second toner compartment 23*b* and part of the toner 28 previously held in the second toner compartment 23*b* is moved to the first toner compartment 23*a*. The toner 28 is thus agitated within the toner container 23. The toner 28 is one-component, non-magnetic toner with toner mother particles thereof coated with an external additive. In accordance with one embodiment of the invention, the external additive contains at least silica.

Referring to FIG. 2, the toner feed roller 24 is arranged in the lower portion of the first toner compartment 23*a* in a manner such that the toner feed roller 24 is clockwise rotatable. The development roller 25 is counterclockwise rotatably supported on the outside of the housing 22 as illustrated in FIG. 2. The development roller 25 is arranged close to the photoconductor unit 3 (in a non-contact fashion). The development roller 25 is pressed against the toner feed roller 24 at a predetermined pressure through an opening 22*a* of the housing 22. The toner regulator member 26 is also arranged on the housing 22. The toner regulator member 26 remains in contact with the development roller 25 downstream of a nip (contact point) between the development roller 25 and the toner feed roller 24. The toner regulator member 26 regulates a thickness of the toner 28 fed to the development roller 25 from the toner feed roller 24. The toner 28 regulated by the toner regulator member 26 is transported to the photoconductor unit 3 by the development roller 25. The electrostatic latent image is thus developed into the toner image on the photoconductor unit 3 by the toner 28 transported by the development roller 25. The toner image of each color thus results on the photoconductor unit 3.

Figure 3A:
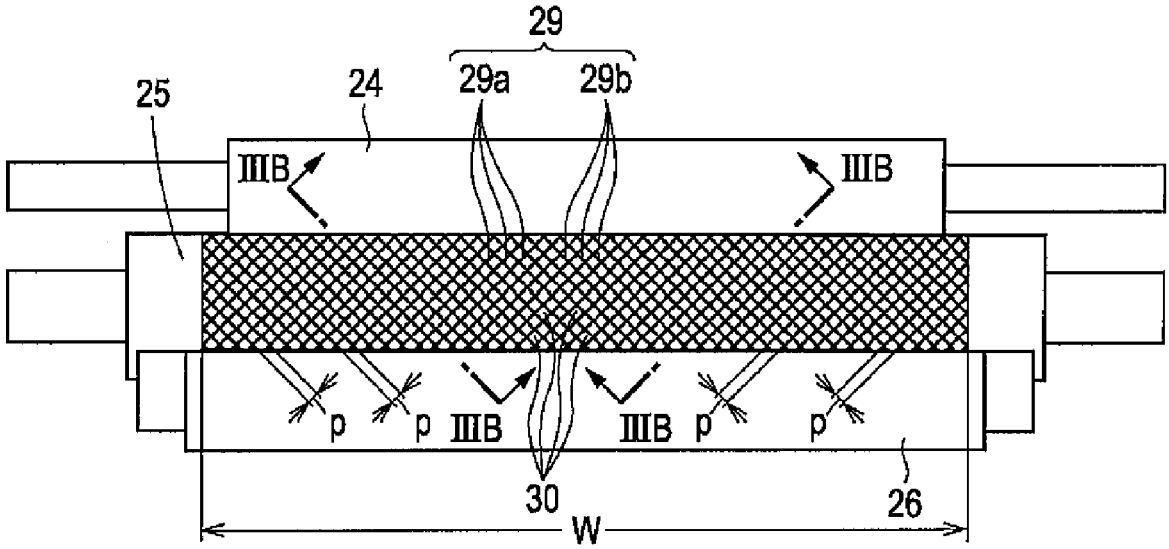
FIG. 3A diagrammatically illustrates a development roller, a toner feed roller, and a toner regulator unit.

FIG. 3A illustrates the circumference surface of the development roller 25 that has the same mesh roughness pattern as the one on the development roller discussed with reference to Japanese Unexamined Patent Application Publication No. JP-A-2007-121948. In the development roller 25, grooves 29 are formed in a roughness pattern in predetermined positions in the axial direction thereof on the whole circumference surface. The grooves 29 include first grooves 29*a* of a predetermined number continuously spiraling at a predetermined angle with respect to the axial direction of the development roller 25 (the predetermined slant angle is 45° in FIG. 3A, but not limited to 45°), and second grooves 29*b* of a predetermined number continuously spiraling at an angle opposite to the slant angle of the first grooves 29*a*. The first and second grooves 29*a* and 29*b* are formed at the respective slant angles at a predetermined pitch p with regular interval of W along the axial direction of the development roller 25. The first and second grooves 29*a* and 29*b* may be different from each other in slant angle and pitch.

Figure 3B:
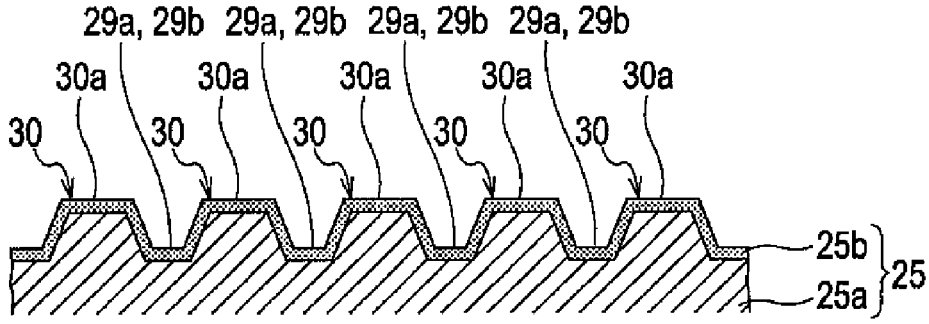
FIG. 3B is a partial sectional view illustrating part of the development roller and taken along line IIIB-IIIB in FIG. 3A.

With reference to FIG. 3B, the development roller 25 includes a base unit 25*a*, and a surface layer 25*b* formed on the circumference surface of the base unit 25*a*. The base unit 25*a* is a metal sleeve made of an aluminum based metal such as 5056 aluminum alloy or 6063 aluminum alloy, or an iron based metal such as STKM steel. The surface layer 25*b* is a nickel-based or chromium-based layer plated on the base unit 25*a*.

The use of the surface layer 25*b* thus improves electrical characteristics and surface hardness of the development roller 25. The durability and toner charging property of the development roller 25 are thus increased.

Figure 3C:
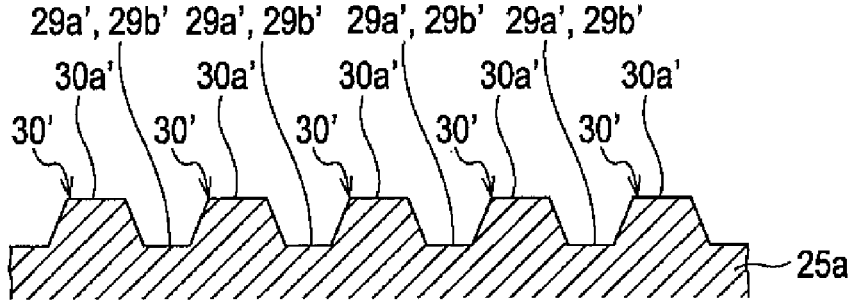
FIG. 3C is a partial sectional view illustrating a base unit of the development roller.

Referring to FIG. 3C, first and second grooves 29*a*' and 29*b*' serving as a base for the first and second grooves 29*a* and 29*b* are formed on the circumference surface of the base unit 25*a* of the development roller 25 through component rolling. The machining method of forming the first and second grooves 29*a*' and 29*b*' may be any known method. The discussion of the machining method is thus omitted here. The base unit 25*a* has island projections 301 of a predetermined number surrounded by the first and second grooves 29*a*' and 29*b*'. In the specification, the projections 30 refer to a projection protruded from the bottom of each of the first and second grooves 29*a*' and 29*b*'.

The base projection 30, is square if the first and second base grooves 29*a*' and 29*b*' have a slant angle of 45° and the same pitches, and is diamond if the first and second slant base grooves 29*a*' and 29*b*' have a slant angle of other than 45° and the same pitches. The base projection 301 is rectangular if the first and second base grooves 29*a*' and 29*b*' have a slant angle of 45° and different pitches, and is parallelogrammic if the first and second base grooves 29*a*' and 29*b*' have a slant angle of other than 45° and different pitches.

The circumference surface of the base unit 25*a* having the first and second base grooves 29*a*' and 29*b*' and the base projections 30' is electroless nickel plated. The surface layer 25*b* is thus formed on the surface of the base unit 25*a*. The first and second grooves 29*a* and 29*b* and the projection 30 are formed on the surface layer 25*b* in a curved surface similar to the first and second base grooves 29*a*' and 29*b*' and the base projection 30'. It is noted that the first and second grooves 29*a* and 29*b* are respectively smaller than the first and second base grooves 29*a*' and 29*b*' and that the projection 30 is larger than the base projection 30'.

The first and second grooves 29*a* and 29*b* and the projections 30 form a roughness portion (recesses and projections) on the circumference of the development roller 25. The left and right side walls of the projection 30 (borders between the recesses and projections) are inclined so that the projection 30 is tapered with a width of the projection 30 (a length of the projection 30 extending from the left side wall thereof to the right side wall thereof in FIG. 3B) gradually narrowed as the projection 30 extends from the bottom to the top thereof. FIG. 3B is a sectional view of the development roller 25 taken along an axial line thereof. If viewed in a cross section taken in a circumferential line of the development roller 25 (in the direction of rotation of the development roller 25), the projections 30 are also tapered with the two side walls inclined. More specifically, the projection 30 is tapered with four side walls inclined, and thus forms a quadrangular pyramid frustum.

First Embodiment

Swollen portions 30*b*' of a predetermined number raised from a base flat surface 30*a*' of the base projection 30' (regular surface of the base unit 25*a*, i.e., the circumference surface of the base unit 25*a*) are formed at the upper side edge of the base projection 30' of the base unit 25*a* manufactured through component rolling as previously discussed with reference to FIG. 4A. Base recesses 30*c*' of a predetermined number dented downward from the base flat surface 30*a*' may be formed within the upper side edges of the base flat surface 30*a*' of the base projection 30'. The height of the swollen portions 30*b*' from the base flat surface 30*a*' and the depth of the base recesses 30*c*' are respectively negligibly smaller than the height of the base projection 30' and the depth of the first and second base grooves 29*a*' and 29*b*'. The swollen portion 30*b*' of the base projection 30' causes a swollen portion 30*b* raised from the flat surface 30*a* to be formed at the upper side edge of the projection 30 on the surface layer 25*b* plated on the circumference of the base unit 25*a*. The base recess 30*c*' causes a recess 30*c* dented from the flat surface 30*a* within the upper side edges of the flat surface 30*a* on top of the projection 30 on the surface (plated) layer 25*b*.

In the development roller 25, the thickness t of the surface layer 25*b* is set to be larger than a maximum height $h_1$ of the highest one of the base swollen portions 30*b*' from the base flat surface 30*a*'. The thickness t of the surface layer 25*b* is also set so that the height $h_2$ of the deepest one of the recesses 30*c* of the surface layer 25*b* in the projection 30 from the base flat surface 30*a*' is larger than the height $h_1$ of the base swollen portion 30*b*'. In other words, $h_1<h_2<t$.

Figure 8A:
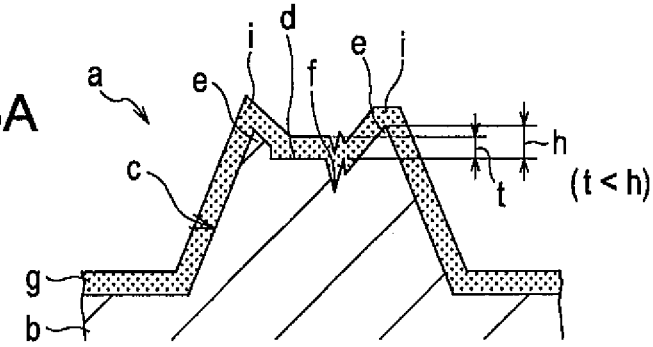
FIG. 8A is a partial sectional view illustrating a portion of the projection swollen in a radial direction of the development roller in the related art.
Figure 8B:
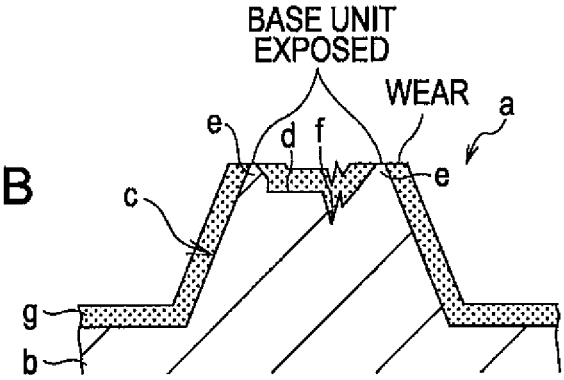
FIG. 8B is a partial sectional view illustrating the wear of the projection of the development roller in FIG. 8A.
Figure 8C:
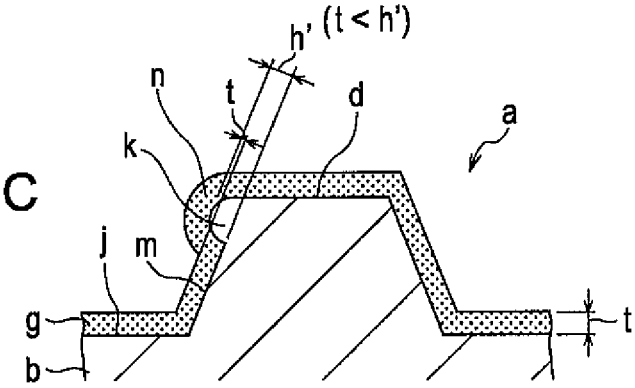
FIG. 8C is a partial sectional view illustrating a portion swollen in a direction looking toward the recess of the development roller in the related art.
Figure 8D:
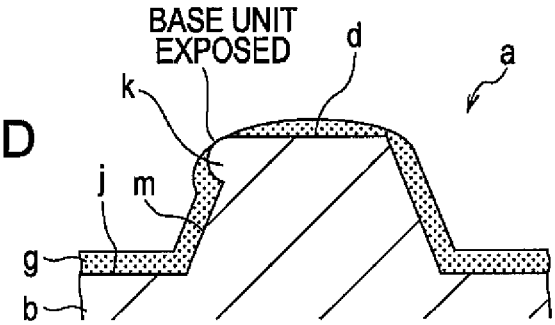
FIG. 8D is a partial sectional view illustrating the wear of the projection in FIG. 5C.

The inventor of the invention has paid attention to the fact that the surface layer 25*b* of the development roller 25 is worn in different wear traces as illustrated in FIGS. 8A and 8D. FIG. 8A illustrates that the flat surface 30*a* of the projection 30 of the development roller 25 is worn in a substantially flat configuration. FIG. 8D illustrates that the flat surface 30*a* of the projection 30 of the development roller 25 is worn in a curved configuration. The wear traces were measured using Keyence VK-9500 as a three-dimensional measuring laser microscope.

The inventor conducted durability tests to study the substantially flat wear trace and the curved wear trace of the flat surface 30*a* at the top of the projection 30. The image forming apparatus used in the tests was printer model LP9000C manufactured by Seiko Epson. A development roller 25 to be discussed below was used instead of the original development roller in the printer model LP9000C. Printer model LP9000C was modified to employ the development roller 25. Image forming conditions in the durability tests were the standard image forming conditions of the printer model LP9000C.

Before forming the roughness portion on the base unit 25*a*, the base unit 25*a* of the development roller 25, made of STKM steel, was centerless machined in surface finishing. A plurality of base recesses 30*c*' were then formed as illustrated in FIG. 4A. The deepest one of the base recesses 30*c*' had a depth of 1 μm.

Figure 4A:
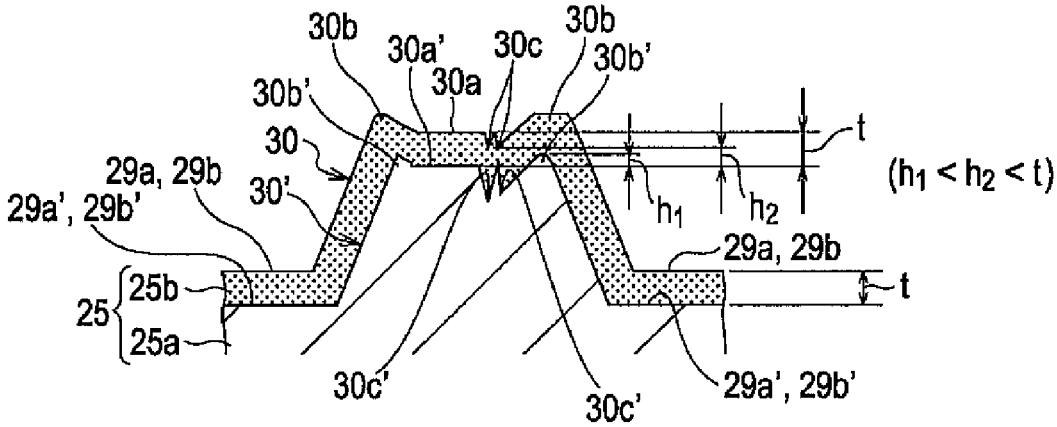

With reference to FIG. 4A, the development roller 25 was machined to form a base roughness portion as below. The base roughness depth (height from the bottom of the base groove to the top surface of the projection) was 3 μm, the base roughness pitch was 100 μm, the width of the base projection along a line extending at half the base roughness depth was 54 μm, and the width of the base recess along the half line was 46 μm. The maximum height h1 of the swollen portion of the base projection from the regular surface of the base projection was 3 μm.

Figure 5A:
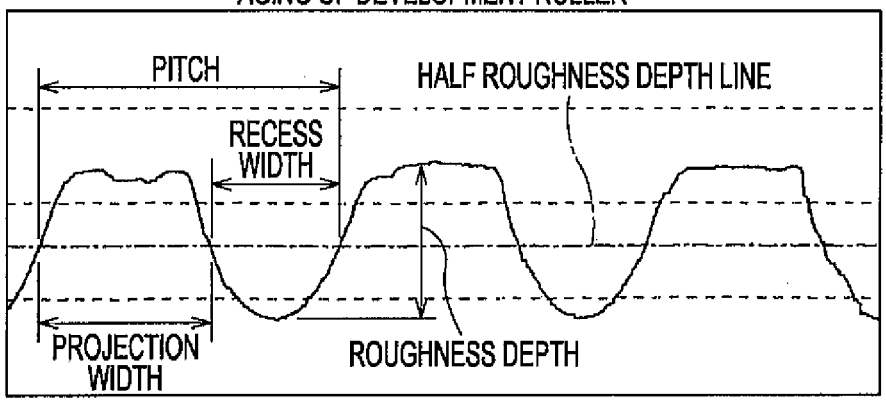

A nickel-phosphorus (Ni—P) layer was electroless plated to a thickness of 3 μm as the surface layer 25*b* on the base unit 25*a*. As illustrated in FIG. 5A, the development roller 25 had a base roughness depth (height from the bottom of the base grooves 29*a* and 29*b* to the top surface of the projection 30) of 6 μm, a base roughness pitch of 100 μm, a width of the base projection at the half line of the base roughness depth of 60 μm, and a width of the base recess (first and second grooves 29*a* and 29*b*) along the half line of 40 μm. A plurality of recesses 30*c* were formed on the surface layer 25*b* at the flat surface 30*a* of the projection 30. The height $h_2$ of the deepest recess 30*c* of the surface layer 25*b* from the base flat surface 30*a*' was 4.5 μm (i.e., the maximum height h1 of the base swollen portion 30*b*'<the height $h_2$ of the deepest recess 30*c* of the surface layer 25*b*<the thickness t of the surface layer 25*b*). The base roughness portion (the grooves 29*a*' and 29*b*', and the projection 30') and a surface roughness portion (the grooves 29*a* and 29*b*, and the projection 30) were measured using Keyence VK-9500 as a three-dimensional measuring laser microscope.

The toner feed roller 24, made of urethane foam, was installed to press against the development roller 25 by an amount of sink of 1.5 mm. The toner regulator member 26 is constructed of a blade made of urethane rubber, and installed to be pressed against the development roller 25 under a pressure of 40 g/cm.

Four types of toner were used. A first type of toner was produced by manufacturing polyester particles through a pulverizing process, and by internally dispersing proper amounts of a charge control agent (CCA), a wax, and a pigment with the polyester particles into toner mother particles. Then externally added to the toner mother particles were small silica particles having a size of 20 nm, median silica particles having a size of 40 nm, and titania particles having a size of 30 nm. The process resulted in large size toner having an average diameter D50 of 8.5 μm. A second type of toner was produced by manufacturing polyester particles through a pulverizing process, and by internally dispersing proper amounts of a CCA, a wax, and a pigment with the polyester particles into toner mother particles. Then externally added to the toner mother particles were small silica particles having a size of 20 nm, median silica particles having a size of 40 nm, large silica particles having a size of 100 nm, and titania particles having a size of 30 nm. The process resulted in large size toner having an average diameter D50 of 6.5 μm. A third type of toner was produced by manufacturing polyester particles through a pulverizing process, and by internally dispersing proper amounts of a CCA, a wax, and a pigment with the polyester particles into toner mother particles. Then externally added to the toner mother particles were small silica particles having a size of 20 nm, median silica particles having a size of 40 nm, large silica particles having a size of 100 nm, and titania particles having a size of 30 nm. The process resulted in small size toner having an average diameter D50 of 4.5 μm. A fourth type of toner was produced by manufacturing styrene acrylate particles through a polymerization process, and by internally dispersing proper amounts of a wax, and a pigment with the styrene acrylate particles into toner mother particles. Then externally added to the toner mother particles were small silica particles having a size of 20 nm, median silica particles having a size of 40 nm, large silica particles having a size of 100 nm, and titania particles having a size of 30 nm. The process resulted in small size toner having an average diameter D50 of 4.5 μm.

Figure 5B:
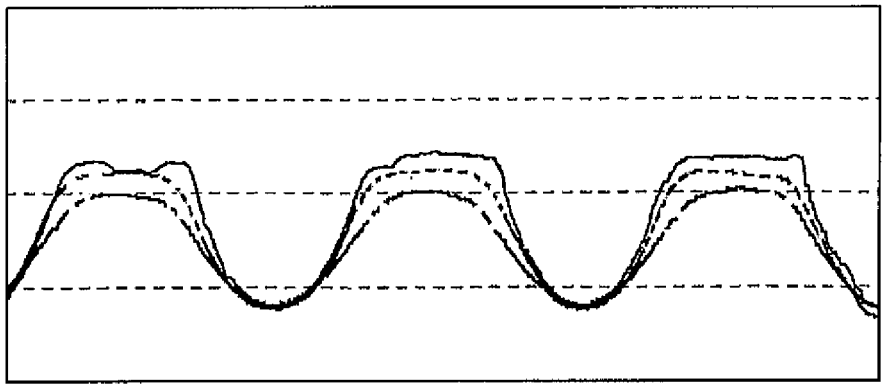

Durability image forming tests were conducted on A4 size standard sheets using a text pattern having a monochrome image occupancy rate of 5% under the standard image forming condition of the printer model LP9000C. When the first type large size toner was used, the top four side edges of the surface layer 25*b* at the projection 30 having an initial profile denoted by a solid line in FIG. 5B were worn into a curved profile denoted by a broken line as the number of image forming cycles increased. As the number of image forming cycles further increased, the original profile was worn into a profile having a curved flat surface 30*a* of the surface layer 25*b* of the projection 30 as denoted by a dot-and-dash chain line. When the second type large size toner was tested, the projections 30 tended to be worn into the curved profile similar to that when the first type toner was used.

Figure 5C:
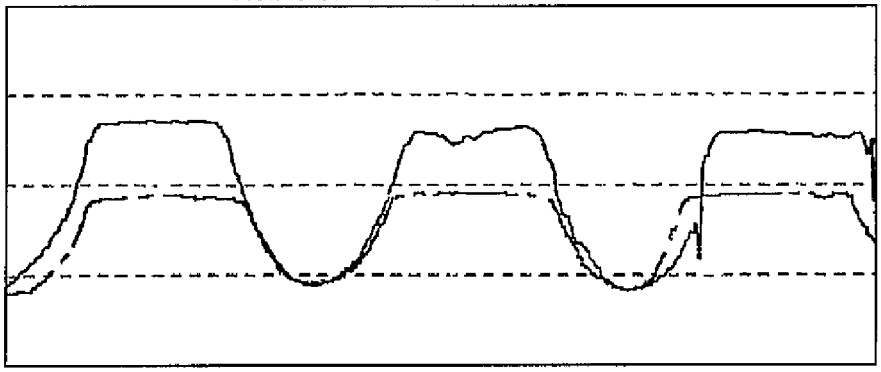

When the third type small size toner was used, the top four side edges of the surface layer 25*b* at the projection 30 having an initial profile denoted by a solid line in FIG. 5C were worn into a flat profile denoted by a dot-and-dash chain line as the number of image forming cycles increased. When the fourth type small size toner was tested, the projections 30 tended to be worn into the flat profile similar to that when the third type small toner was used.

The wear profile is analyzed more in detail. The curved wear profile illustrated in FIG. 5B tends to occur if the toner particle diameter (D50 diameter, namely, average particle diameter of 50% volume) is larger than the roughness depth of the development roller 25 (i.e., the toner particle diameter>the roughness depth of the development roller 25). The substantially flat wear profile illustrated in FIG. 5C tends to occur if the toner particle diameter (D50 diameter, namely, average particle diameter of 50% volume) is smaller than the roughness depth of the development roller 25 (i.e., the toner particle diameter<the roughness depth of the development roller 25).

The possible reason why such a wear profile occurred is described below. As the development roller 25 rotates in FIG. 6A, the toner feed roller 24 and the toner regulator member 26 are respectively pressed against the development roller 25. Toner particles present on the flat surfaces 30*a* of the projections 30 move into the first and second grooves 29*a* and 29*b*. Since the average diameter of the toner particles is larger than the roughness depth, almost all the toner particles of the toner 28 having moved into the first and second grooves 29*a* and 29*b* are aligned in a single layer. As the development roller 25 further rotates, toner particles present in the first and second grooves 29*a* and 29*b* move onto the flat surfaces 30*a* of the projections 30. As illustrated in FIG. 6B, the relatively hard external additive on the surface of each toner particle gradually wears the surface of the surface layer 25*b* and the upper edges thereof in the long service life.

Figure 6A:
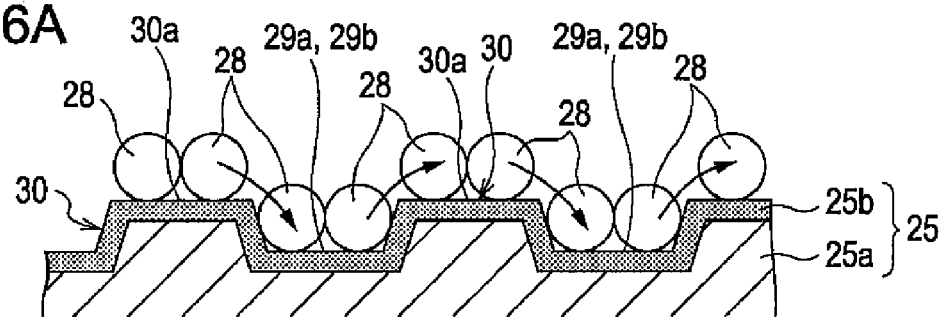
Figure 6B:
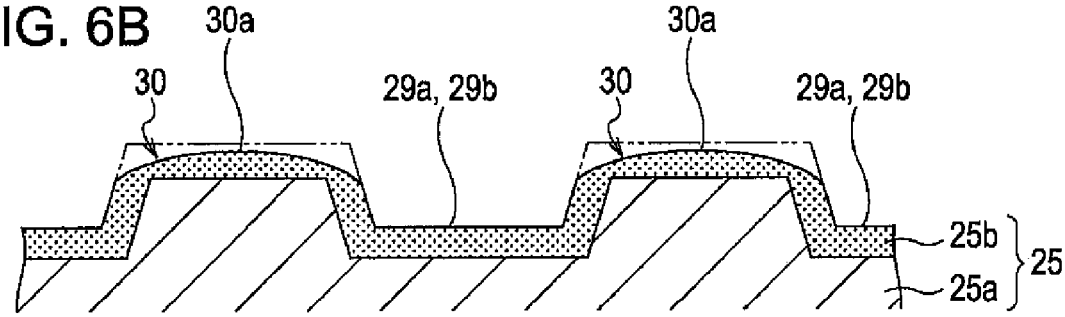
Figure 6C:
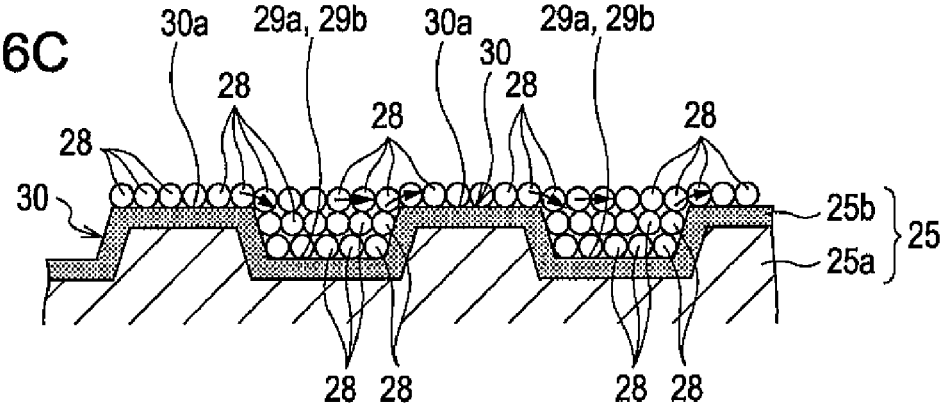
Figure 6D:
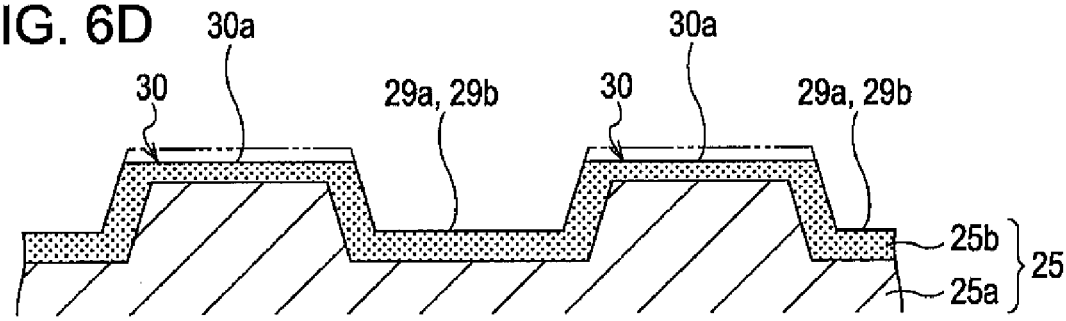

As FIG. 3B, FIGS. 6A and 6D are sectional views of the first and second grooves 29*a* and 29*b* taken in a line perpendicular to the running direction of the grooves. The partial sectional views of the development roller 25 are not aligned with the direction of rotation of the development roller 25. Toner particles on the first grooves 29*a* thus move on the flat surfaces 30*a* of the projections 30, and then move to any of the first and second grooves 29*a* and 29*b* adjacent to the projections 30. Furthermore, toner particles on the second grooves 29*b* move on the flat surfaces 30*a* of the projections 30, and then move to any of the first and second grooves 29*a* and 29*b* adjacent to the projections 30. The toner movement is identical to the other examples of the development roller 25.

If the toner particle diameter (D50 particle diameter) is smaller than the depth of the roughness portion as illustrated in FIG. 6C, the surface of the surface layer 25*b* at the projection 30 is worn in a substantially flat configuration as illustrated in FIG. 6D. The reason for this is described below. As the development roller 25 rotates in FIG. 6C, toner particles present on the flat surfaces 30*a* of the projections 30 move into the first and second grooves 29*a* and 29*b*. Since the average diameter of the toner particles is smaller than the roughness depth, almost all the toner particles of the toner 28 having moved into the first and second grooves 29*a* and 29*b* are aligned in a plurality of layers. As the development roller 25 further rotates, toner particles present in the first and second grooves 29*a* and 29*b* move onto the flat surfaces 30*a* of the projections 30. Since the top layer of toner particles is then about at the same level as the flat surface 30*a* of the projection 30, mainly the toner particles at the top layer out of the toner particles in the first and second grooves 29*a* and 29*b* horizontally move, and most of the remaining toner particles remain stationary. In the course of the movement of the top layer toner particles, the external additive having a relatively high hardness coating the toner mother particles gradually wears the surface of the surface layer 25*b* into a substantially flat state.

Figure 4B:
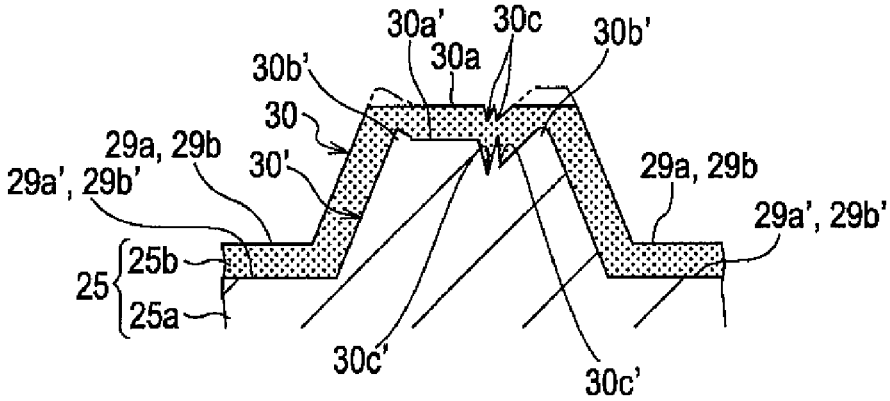

If the development device 5' including the development roller 25 illustrated in FIG. 4A has been used for a long period of time with the toner 28 having the average diameter (D50 average diameter) smaller than the depth of the roughness portion of the development roller 25, the flat surface 30*a* of the surface layer 25*b* at the projection 30 is worn in a substantially flat configuration. All the swollen portions 30*b* are then worn out as illustrated in FIG. 4B, and the four side walls of the projection 30 are inclined as previously discussed. An area of the top portion 30*a* receiving a force applied by the toner feed roller 24, the tone regulator blade 26, etc. increases. A pressure acting on the top portion 30*a* is thus reduced. The wearing of the surface layer 25*b* at the projection 30 is thus controlled. Since the thickness t of the surface layer 25*b* is larger than the maximum height $h_1$ of the base swollen portion 30*b*', the base swollen portion 30*b* ' is not exposed at an early stage of service.

Figure 4C:
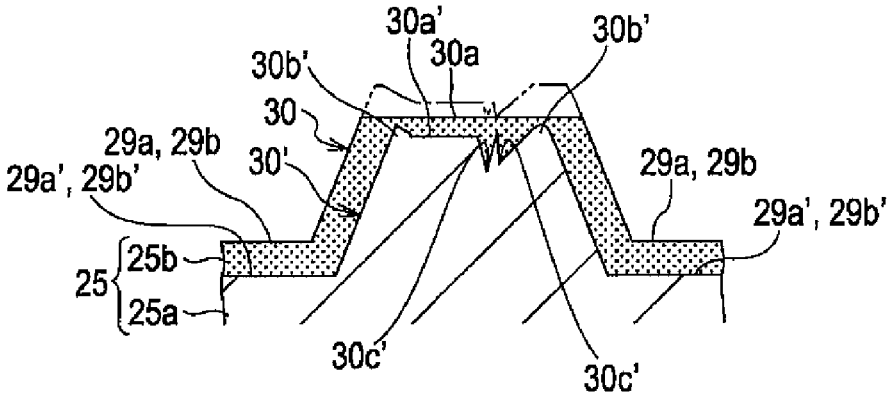

As the image forming operation is repeated, the flat surface 30*a* of the surface layer 25*b* at the projection 30 is gradually worn. The deepest recess 30*c* on the flat surface 30*a* at the projection 30 is then eliminated (i.e., all the recesses 30*c* are eliminated) as illustrated in FIG. 4C. The elimination of the recesses 30*c* and the presence of the inclined side walls of the projection 30 increases a pressure receiving area of the flat surface 30*a* as the top of the worn projection 30. The pressure applied on the top of the flat surface 30*a* is reduced more. The wear rate of the surface layer 25*b* at the projection 30 is thus further reduced. Since the height $h_2$ of the bottom of the deepest recess 30*c* on the surface layer 25*b* from the base flat surface 30*a*' is larger than the maximum height $h_1$ of the base swollen portion 30*b*', the base swollen portion 30*b*' is not exposed even if the deepest recess 30*c* is eliminated. Since the flat surface 30*a* at the top of the projection 30 is relatively smooth, a toner regulating method that causes the flat surface 30*a* at the top to be substantially fully covered with toner particles (preferably with a 100% coverage) is preferred when the toner regulator member 26 regulates the toner.

In the development roller 25, the thickness t of the development (plated) roller 25 is set to be larger than the maximum height $h_1$ of the base swollen portion 30*b*' from the base flat surface 30*a*' of the highest base swollen portion 30*b*'. After a long service life of image forming, the swollen portion 30*b* of the surface layer 25*b* corresponding to the base swollen portion 30*b*' is expected to first worn out. Even after the elimination of the swollen portion 30*b* of the surface layer 25*b*, the base swollen portion 30*b*' of the base unit 25*a* remains unexposed. With the swollen portion 30*b* of the surface layer 25*b* eliminated, the surface layer 25*b* at the projection 30 becomes the flat surface 30*a* as the top surface corresponding to the regular surface of the base projection 30'. The flat area of the surface layer 25*b* at the projection 30 thus increases. In this condition, the wear rate of the flat surface 30*a* of the surface layer 25*b* at the top of the projection 30 is controlled. The wearing of the surface layer 25*b* is effectively controlled for a long period of time.

In comparison with the development roller of the related art, the development roller has an increased durability and maintains the toner charging property at an excellent level for a long period of time. The thickness t is set so that the height $h_2$ of the deepest one of the recesses 30*c* of the surface layer 25*b* in the projection 30 from the base flat surface 30*a*' is larger than the height $h_1$ of the base swollen portion 30*b*'. The durability of the development roller 25 is increased further. The base unit 25*a* is not exposed for a long period of time. Even if an iron-based material is used for the base unit 25*a*, the base unit 25*a* is prevented from being corroded for a long period of time.

The development device 5' including the development roller 25 maintains the toner charging property of the photoconductor unit 3 for a long period of time. The use of the toner 28 having the average particle diameter (D50 average diameter) smaller than the depth of the roughness portion of the development roller 25 allows the flat surface 30*a* of the surface layer 25*b* at the projection 30 to worn in a substantially flat configuration. The wearing of the surface layer 25*b* is thus controlled for a long period of time.

In accordance with one embodiment of the invention, the height $h_2$ of the bottom of the deepest recess 30*c* is not necessarily set to be larger than the height $h_1$ of the base swollen portion 30*b*'. However, to increase effectively the durability of the development roller 25, the height $h_2$ is preferably set to be larger than the height $h_1$ The number and pitch of the second grooves 29*b* may or may not be identical to the number and pitch of the first grooves 29*a*. The number of first grooves 29*a* may be 1 or more, and the number of second grooves 29*b* may be 1 or more.

The toner 28 having the average particle diameter (D50 average diameter) larger than the depth of the roughness portion of the development roller 25 may be used. In such a case, the flat surface 30*a* of the surface layer 25*b* at the projection 30 is worn in a curved configuration. The durability of the development roller 25 is thus increased. However, the development roller 25 does not have so high a durability as the development roller 25 when the toner 28 having the average particle diameter (D50 average diameter) smaller than the depth of the roughness portion of the development roller 25 is used. In view of achieving a high durability of the development roller 25, the use of the toner 28 having the average particle diameter (D50 average diameter) smaller than the depth of the roughness portion of the development roller 25 is preferable.

The toner particles are coated with silica having a relatively high hardness as an external additive with the silica coverage ratio to the toner mother particles being 100% or more. Silica is abundant in the surface of the toner mother particles and separated silica is also abundant in the toner. This causes a relatively high wear rate in the surface layer 25*b* of the projection 30. Such toner is typically used when toner fluidity is needed in one-component non-magnetic non-contact development. Even if the development roller 25 is used in the development device 5'that uses the toner having a silica coverage rate of 100% or more, the durability of the development roller 25 is effectively increased.

The image forming apparatus 1 including the development device 5' can thus provide excellent images for a long period of time.

As FIGS. 4A and 4B, FIGS. 7A and 7B are partial sectional views illustrating part of a development roller in accordance with one embodiment of the invention. Elements identical to those illustrated in FIGS. 4A and 4B are designated with the same reference numerals and the discussion thereof is omitted here.

Figure 7A:
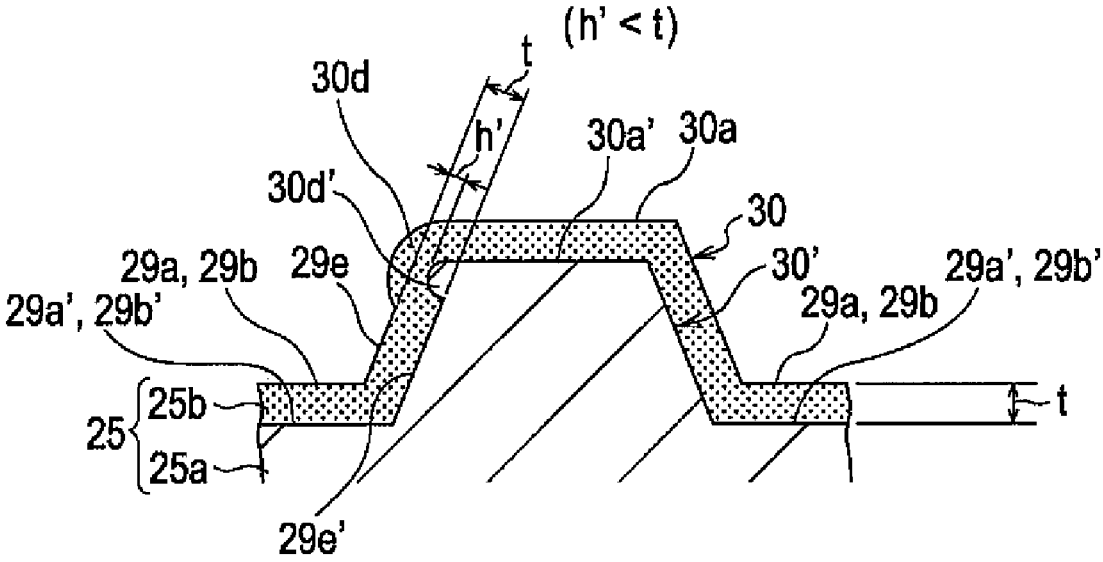
FIG. 7A partially illustrates a development roller in accordance with another embodiment of the invention.

Referring to FIG. 7A, the development roller 25 includes a swollen portion 30*d* expanding in a direction toward the first groove 29*a*. The swollen portion 30*d* is created when the first and second grooves 29*a* and 29*b* are created through component rolling. In the development roller 25 as well, the thickness t of the surface layer 25*b* is set to be larger than an extension (height) h' of a swollen portion 30*d*' of the base unit 25*a* from a base side surface 29*e*' (regular surface of the base unit 25*a*) of a side wall 30*e*.

The development device 5' including the development roller 25 uses the toner 28 (not shown in FIGS. 7A and 7B) having the average particle diameter (D50 average diameter) larger than the depth of the roughness portion of the development roller 25.

Figure 7B:
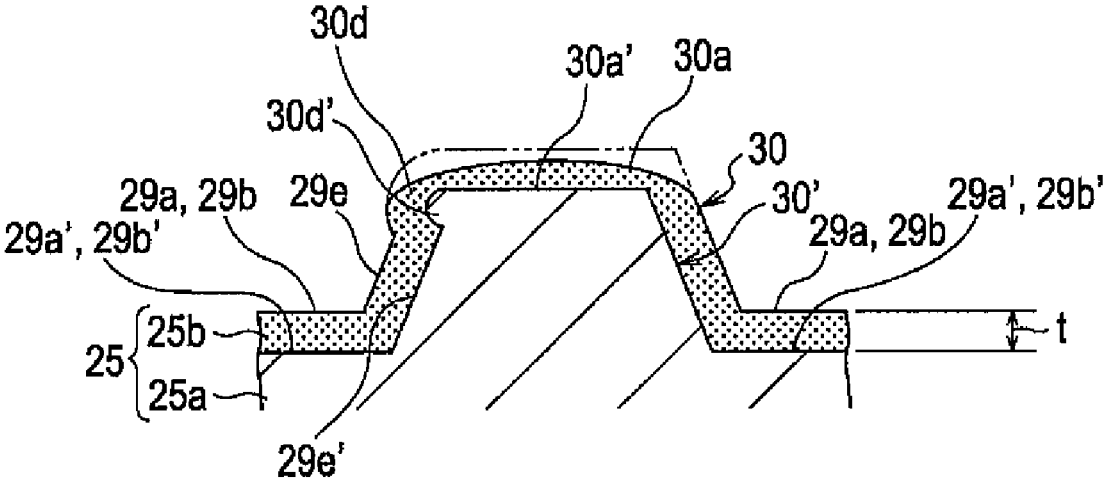
FIG. 7B illustrates the wear state of the development roller in FIG. 7A.

If the image forming apparatus 1 including the development device 5' has been used for a long service life, the flat surface 30*a* of the surface layer 25*b* at the top of the projection 30 illustrated in FIG. 7B is worn in a curved configuration. Since the thickness t of the surface layer 25*b* is set to be larger than the height h' of the base swollen portion 30*d*', the base swollen portion 30*d*' of the base unit 25*a* is not exposed rapidly.

The structure and operation of each of the development roller 25, the development device 5', and the image forming apparatus 1 remain substantially identical to those previously described.

The development device 5' including the development roller 25 may use the toner 28 (not shown in FIGS. 7A and 7B) having the average particle diameter (D50 average diameter) smaller than the depth of the roughness portion of the development roller 25. In this case, the surface layer 25*b* at the flat surface 30*a* of the projection 30 is worn in a substantially flat configuration. If the surface layer 25*b* at the flat surface 30*a* of the projection 30 is gradually worn, a pressure receiving area of the surface 30*a* receiving a force from the toner feed roller 24, the toner regulator member 26, etc. expands. The pressure acting on the surface 30*a* at the top is thus decreased. The wearing of the surface layer 25*b* at the projection 30 is controlled.

Second Embodiment

Figure 9A:
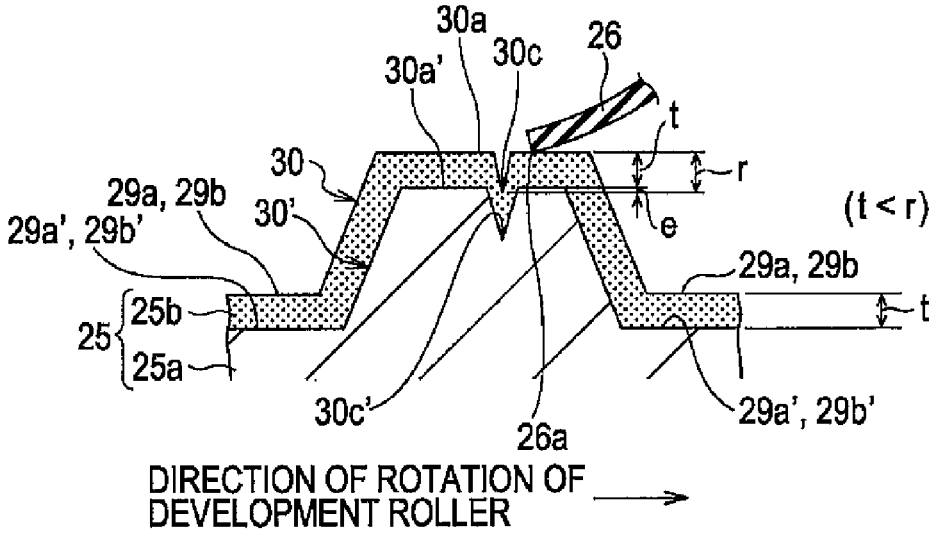

Referring to FIG. 9A, a plurality of small recesses 30*c*' dented downward from the base flat surface 30*a*' (only one base dent 30*c*' is illustrated in FIG. 9A) are formed in the base flat surface 30*a*' of the base projection 30, of the base unit 25*a* as previously discussed. These base recesses 30*c*' are created by making streak scratches with any appropriate means in a surface finish process prior to the roughening process of the base unit 25*a*. Instead of streak base recesses 30*c*', the base recesses 30*c*' may be formed using micro blasting.

The base flat surface 30*a*' of the base projection 30' with a plurality of micro base recesses 30*c*' has a predetermined surface roughness r'. The surface layer 25*b* of the flat surface 30*a* at the projection 30 covering the base flat surface 30*a*' of the base projection 30' also has a plurality micro recesses 30*c* dented downward from the flat surface 30*a* in accordance with the base recesses 30*c*'. In such a case, the surface layer 25*b* is produced through electroless plating, and micro recesses 30*c* precisely reflects the configuration of the base recesses 30*c*'.

A surface roughness r of the flat surface 30*a* of the projection 30 of the surface layer 25*b* is set to be larger than the thickness t of the surface layer 25*b* (t<r). The surface roughness r may be a ten point average height Rz. In other words, the ten point average height Rz of the flat surface 30*a* of the projection 30 of the surface layer 25*b* is set to be larger than the thickness t of the surface layer 25*b* (t<Rz). The ten point average height Rz of the flat surface 30*a* can be measured using SURFTEST (surface roughness measuring instrument) manufactured by Mitutoyo.

The center line average height (Ra) or the maximum height (Rmax) may be used as the surface roughness r. The measurement of these surface roughnesses is known and the discussion thereof is omitted here. A surface roughness r' of the base flat surface 30*a*' of the base projection 30' can be measured in a similar fashion.

Durability tests were conducted on the development roller 25. The image forming apparatus used in the tests was printer model LP9000C manufactured by Seiko Epson. A development roller 25 to be discussed below was used instead of the original development roller in the printer model LP9000C. Printer model LP9000C was modified to employ the development roller 25. Image forming conditions in the durability tests were the standard image forming conditions of the printer model LP9000C.

Before forming the roughness portion on the base unit 25*a*, the base unit 25*a* of the development roller 25, made of STKM steel, was centerless machined in surface finishing. A plurality of steak recesses 30*c*' were then formed as illustrated in FIG. 9A. The ten point average height Rz of the base flat surface 30*a*' of one base projection 30' of the base unit 25*a* was 2 μm.

With reference to FIG. 9A, the development roller 25 was machined to form a base roughness portion as below. The base roughness depth (height from the bottom of the base groove to the top surface of the projection) was 4.5 μm, the base roughness pitch was 100 μm, the width of the base projection along a line extending at half the base roughness depth was 57 μm, and the width of the base recess along the half line was 43 μm.

Figure 10A:
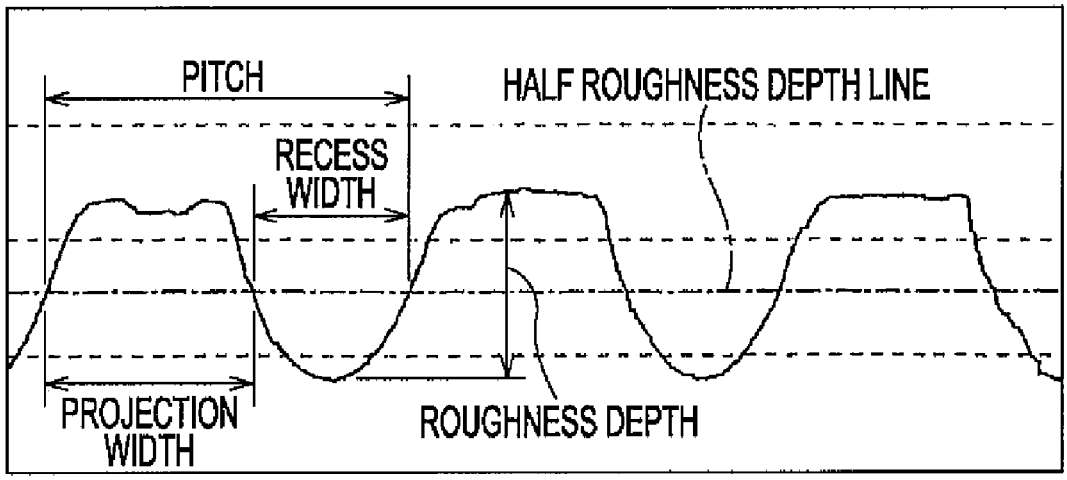

A nickel-phosphorus (Ni—P) layer was electroless plated to a thickness of 1.5 μm as the surface layer 25*b* on the base unit 25*a*. As illustrated in FIG. 10A, the development roller 25 had a base roughness depth (height from the bottom of the base grooves 29*a* and 29*b* to the top surface of the projection 30) of 6 μm, a base roughness pitch of 100 μm, a width of the base projection at the half line of the base roughness depth of 60 μm, and a width of the base recess (grooves 29*a* and 29*b*) along the half line of 40 μm. The base roughness portion (the grooves 29*a*' and 29*b*', and the projection 30') and a surface roughness portion (the grooves 29*a* and 29*b*, and the projection 30) were measured using Keyence VK-9500 as a three-dimensional measuring laser microscope. Subsequent to the production of the surface layer 25*b*, a plurality of streak recesses 30*c* are formed on the surface layer 25*b* of the flat surface 30*a* of the projection 30. The ten point average height Rz of the flat surface 30*a* of the projection 30 was 1.8 μm. In other words, the ten point average height Rz of the flat surface 30*a* was larger than the thickness t of the surface layer 25*b*, which was 1.5 μm (the ten point average height Rz of the flat surface 30*a*>than the thickness t of the surface layer 25*b*).

The toner feed roller 24, made of urethane foam, was installed to press against the development roller 25 by an amount of sink of 1.5 mm. The toner regulator blade 26 was constructed of a blade made of urethane rubber. As illustrated in FIG. 9A, a front edge 26*a* of the toner regulator blade 26 was pressed into contact with the flat surfaces 30*a* of the projections 30 under a pressure of 40 g/cm.

Two types of toner were used. A first type of toner was produced by manufacturing polyester particles through a pulverizing process, and by internally dispersing proper amounts of a charge control agent (CCA), a wax, and a pigment with the polyester particles into toner mother particles. Then externally added to the toner mother particles were small silica particles having a size of 20 nm, median silica particles having a size of 40 nm, large silica particles having a size of 100 nm, and titania particles having a size of 30 nm. The process resulted in small size toner having an average diameter D50 of 4.5 μm, and smaller than the roughness depth of 6 μm. A second type of toner was produced by manufacturing styrene acrylate particles through a polymerization process, and by internally dispersing proper amounts of a wax, and a pigment with the styrene acrylate particles into toner mother particles. Then externally added to the toner mother particles were small silica particles having a size of 20 nm, median silica particles having a size of 40 nm, large silica particles having a size of 100 nm, and titania particles having a size of 30 nm. The process resulted in small size toner having an average diameter D50 of 4.5 μm.

Figure 10B:
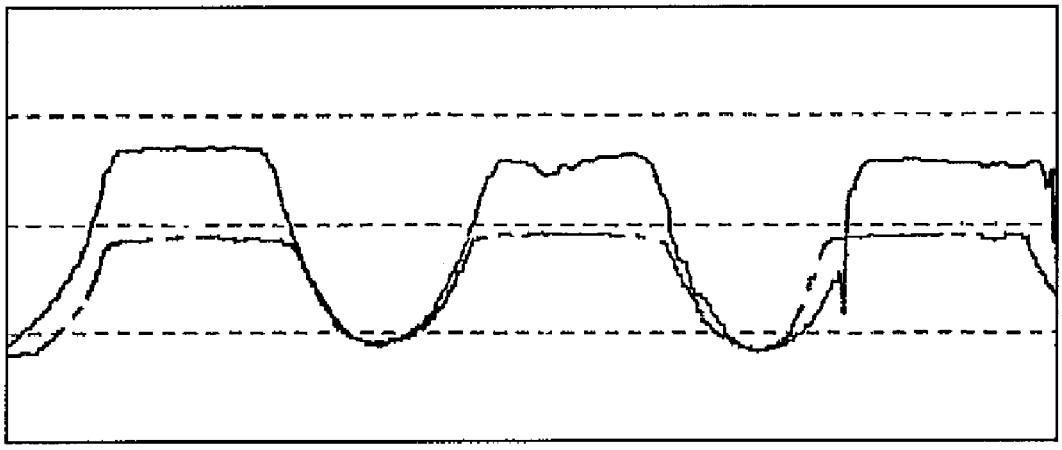
Figure 11A:
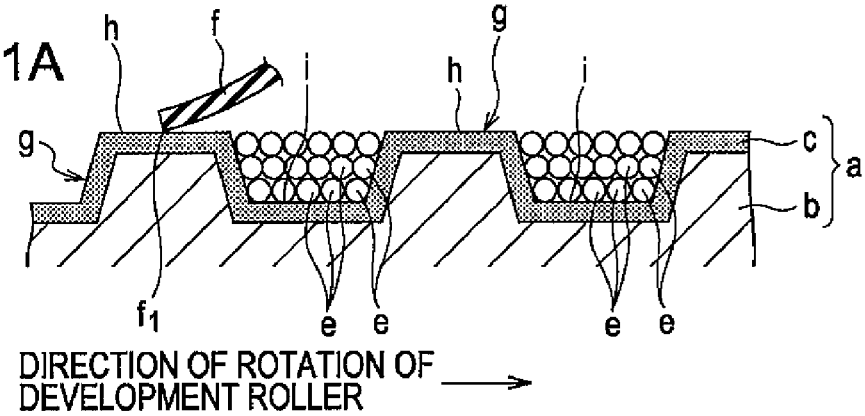
FIG. 11A illustrates a toner regulating method that is performed with a front edge of a toner regulator blade in contact with a flat portion of the projection.
Figure 11B:
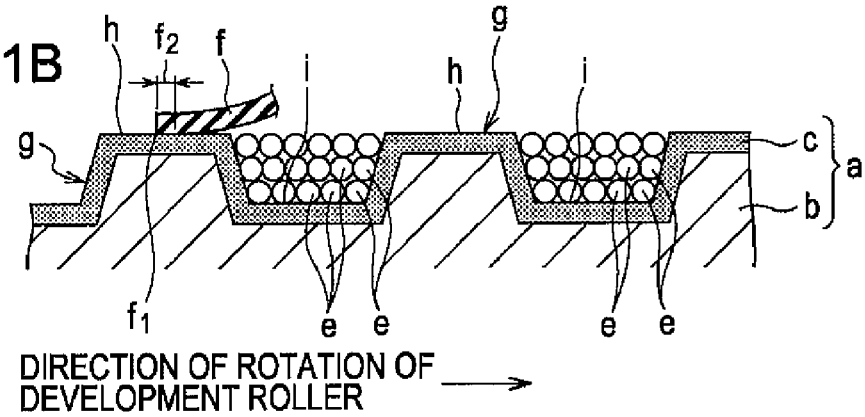
FIG. 11B illustrates a toner regulating method that is performed with a predetermined area containing the front edge of the toner regulator blade in contact with the flat portion of the projection.
Figure 11C:
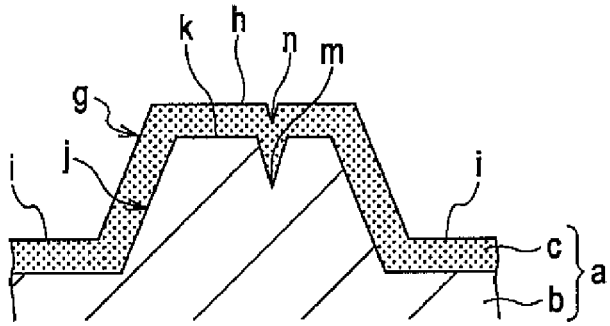
FIG. 11C is a partial sectional view diagrammatically illustrating the projection of the development roller in the related art.
Figure 11D:
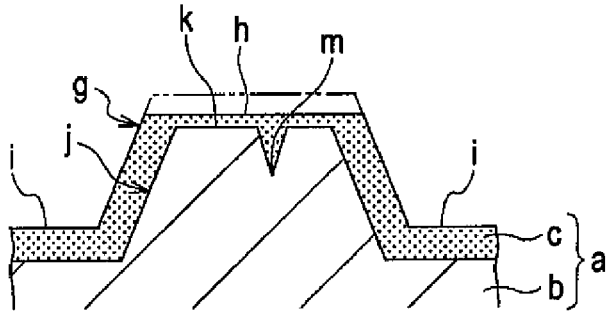
FIG. 11D is a partial sectional view diagrammatically illustrating the wear of the surface layer at the projection.

Durability image forming tests were conducted on A4 size standard sheets using a 25% halftone monochrome image under the standard image forming condition of the printer model LP9000C. When the first type small size toner was used, the flat surface 30*a* of the projection 30 of the surface layer 25*b* at the projection 30 having an initial profile denoted by a solid line in FIG. 10B tended to be worn into a flat profile denoted by a dot-and-dash chain line. When the second type small size toner was tested, the projections 30 tended to be worn into the flat profile similar to that when the first type toner was used.

Figure 9B:
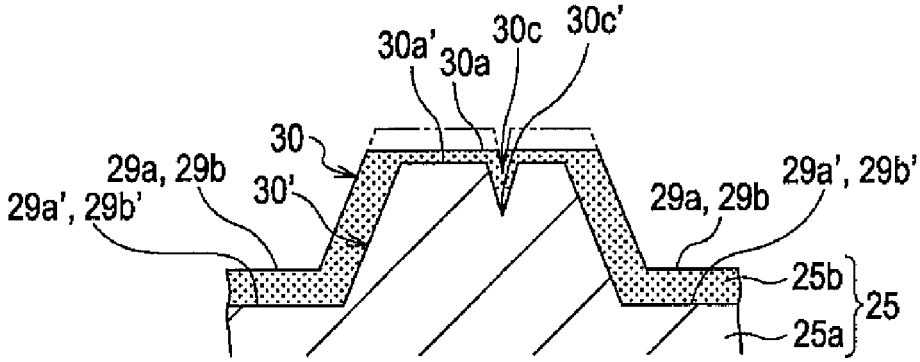

As the image forming operations are repeated by many times, the flat surface 30*a* is worn in a flat configuration as illustrated in FIG. 9B. Although recesses 30*c* of the surface layer 25*b* at the flat surface 30*a* are eliminated, some of the recesses 30*c* still remain. In other words, the surface layer 25*b* of the flat surface 30*a* at the projection 30 maintains a predetermined surface roughness. An increase in the contact area between the toner regulator blade 26 and the flat surface 30*a* of the projection 30 is controlled and the separated external additive of the toner 28 is inserted into the remaining recesses 30*c*. An increase in the contact level between the toner regulator blade 26 and the flat surface 30*a* of the projection 30 is controlled. The uneven sliding and the sound causing of the toner regulator blade 26 sliding on the flat surface 30*a* are thus controlled.

Figure 9C:
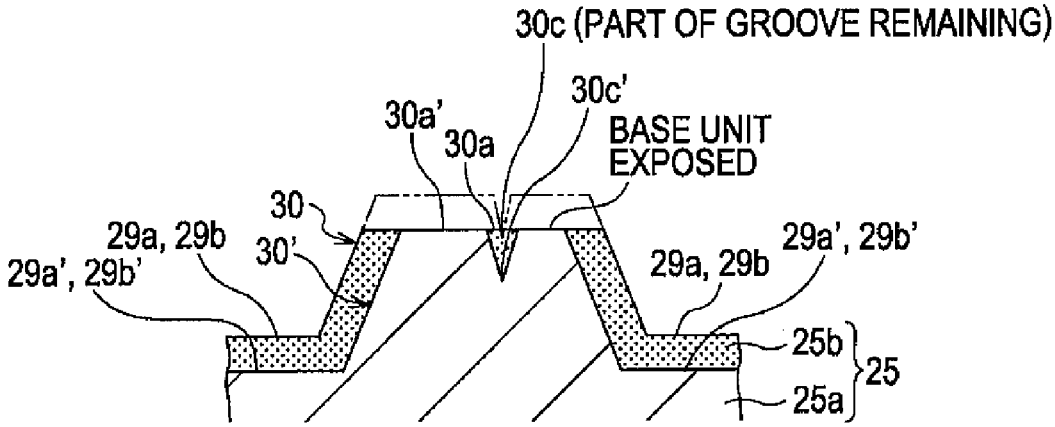

As the image forming operations are repeated further, the flat surface 30*a* of the projection 30 is further worn and the base flat surface 30*a*' of the base projection 30' of the base unit 25*a* is exposed as illustrated in FIG. 9C. The development roller 25 then ends the service life thereof. Although further recesses 30*c* of the surface layer 25*b* at the flat surface 30*a* are eliminated, some of the recesses 30*c* still remain. In other words, the surface layer 25*b* of the flat surface 30*a* at the projection 30 maintains a predetermined surface roughness. The predetermined surface roughness of the flat surface 30*a* of the projection 30 on the development roller 25 controls an increase in the contact level between the toner regulator blade 26 and the flat surface 30*a* of the projection 30 until the base flat surface 30*a*' is exposed at the end of the service life. The durability of the development roller 25 is thus increased.

Since the ten point average height Rz of the flat surface 30*a* of the projection 30 is set to be larger than the thickness t of the surface layer 25*b* (the ten point average height Rz of the flat surface 30*a*>the thickness t of the surface layer 25*b*), the flat surface 30*a* of the projection 30 of the development roller 25 is maintained at a constant surface roughness until the end of the service life of the development roller 25. Since the surface layer 25*b* is electroless plated, micro recesses 30*c* are formed in good similarity with the base recesses 30*c*'. An increase in the contact level between the toner regulator blade 26 and the flat surface 30*a* of the projection 30 is controlled for a long period of time.

The uneven sliding of the toner regulator blade 26 on the development roller 25 and the sound causing of the toner regulator blade 26 are thus controlled. The durability of the development roller 25 and the toner regulator blade 26 is substantially increased. The toner charging property of the development roller 25 is maintained for a long period of time.

Since an increase in the contact level between the toner regulator blade 26 and the flat surface 30*a* of the projection 30 is controlled, an increase in the drive torque of the development roller 25 is also controlled for a long period of time.

The development device 5' containing the development roller 25 can operate for a long period of time, developing toner images on the photoconductor unit 3 in accordance with electrostatic latent images for a long period of time. The image forming apparatus 1 containing the development device 5' can also operate for a long period of time, providing high-quality images.

At least a predetermined area including at least the front edge 26*a* of the toner regulator blade 26 is put into contact with the flat surface 30*a* of the projection 30. In the toner regulating method in which the flat surface 30*a* of the projection 30 is partially covered with the toner, an increase in the contact level between the toner regulator blade 26 and the flat surface 30*a* of the projection 30 is effectively controlled for a long period of time.

If the roughness portion is formed of regular grooves, the sound causing of the toner regulator blade 26 is effectively controlled.

In the above-described embodiments, the invention is applied to the image forming apparatus 1 containing the rotary development unit 5. The invention is not limited to the image forming apparatus 1. The invention is applicable to image forming apparatuses including a development device with the development roller having a roughness portion. Such image forming apparatuses include an image forming apparatus having an image forming units arranged in tandem, a four-cycle image forming apparatus, a monochrome image forming apparatus, and an image forming apparatus that directly transfers a toner image to a transfer material (transfer medium of one embodiment of the invention) from an image bearing unit (i.e., an image forming apparatus having no intermediate transfer medium). The invention is applicable to any image forming apparatus falling within the scope defined by the claims.

The roughness portion of the development roller 25 includes regular grooves produced through component rolling. Alternatively, the roughness portion may be machined in another process such as a cutting process. The invention is applicable to any image forming apparatus falling within the scope of the invention defined in the claims.

What is claimed is:

1. A development roller, comprising a base unit having a base recess and a base projection that are formed in a predetermined area of a circumference surface of the base unit, and a surface layer formed on the circumference surface of the base unit and having a recess and a projection formed respectively in accordance with the base recess and the base projection of the base unit, wherein the base projection includes a flat portion, and wherein a surface roughness of the surface layer on the flat portion is larger than a thickness of the surface layer.

2. The development roller according to claim 1, wherein the surface layer is manufactured through electroless plating.

3. The development roller according to claim 1, wherein the surface roughness of the flat portion is a ten point average height.

4. The development roller according to claim 1, wherein the base recess is a continuously spiraling groove.

5. A development device, comprising a development roller that transports toner to a latent image bearing unit, a toner feed roller that remains in contact with the development roller to feed the toner, and a toner regulator unit that remains in contact with the development roller and regulates an amount of toner to be fed to the latent image bearing unit, wherein the development roller is the development roller according to claim 1, and wherein the toner regulator unit is a toner regulator blade.

6. The development device according to claim 5, wherein at least a front edge of the toner regulator unit remains in contact with the flat portion.

7. An image forming apparatus, comprising a latent image bearing unit on which at least an electrostatic latent image is formed, a development device that develops on the latent image bearing unit a toner image with toner in a non-contact development fashion in accordance with the electrostatic latent image, and a transfer device that transfers the toner image from the latent image bearing unit to a transfer medium, wherein the development device is the development device according to claim 5.

8. The development roller according to claim 1, wherein the base recess and the base projection are formed by pressing a regular pattern in pressure machining.

9. The development roller according to claim 8, wherein the pressure machining comprises component rolling.

10. A development device, comprising a development roller that transports toner to a latent image bearing unit, a toner feed roller that remains in contact with the development roller to feed the toner, and a toner regulator unit that remains in contact with the development roller and regulates an amount of toner to be fed to the latent image bearing unit, wherein the development roller is the development roller according to claim 8, and wherein an average diameter of particles of the toner is smaller than a depth of the recess of the development roller.

11. The development device according to claim 10, wherein the toner comprises one-component non-magnetic toner made of toner mother particles coated with an external additive and wherein the external additive contains at least silica, and wherein a coverage ratio of silica to the toner mother particles is 100% or more.

12. An image forming apparatus, comprising a latent image bearing unit on which at least an electrostatic latent image is formed, a development device that develops on the latent image bearing unit a toner image with toner in a non-contact development fashion in accordance with the electrostatic latent image, and a transfer device that transfers the toner image from the latent image bearing unit to a transfer medium, wherein the development device is the development device according to claim 10.

* * * * *